US005844459A

United States Patent [19]

Larsen

[11] Patent Number: 5,844,459

[45] Date of Patent: Dec. 1, 1998

[54] MAGNET COIL WITH MEANS FOR ASSURING ADJUSTMENT AND FIRM SEATING OF THE COIL BODY IN A YOKE RING

[75] Inventor: Hartmut Larsen, De Haan, Belgium

[73] Assignee: Siemens Aktiengesellschaft, Munich, Germany

[21] Appl. No.: 941,358

[22] Filed: Sep. 30, 1997

[30] Foreign Application Priority Data

Sep. 30, 1996 [DE] Germany ..... 196 40 398.7

[51] Int. Cl.[6] ..... H01F 27/02

[52] U.S. Cl. ..... 336/92; 336/83; 336/96; 336/208

[58] Field of Search ..... 336/90, 92, 96, 336/83, 198, 208, 192

[56] References Cited

U.S. PATENT DOCUMENTS 3,859,614 1/1975 Reithmaier ..... 336/83

FOREIGN PATENT DOCUMENTS 329 706 5/1976 Austria .
2118872 8/1972 France .
78 06 069 7/1978 Germany .

*Primary Examiner*—Thomas J. Kozma
*Attorney, Agent, or Firm*—Hill & Simpson

[57] ABSTRACT

A coil bobbin has first and second end flanges with the first end flange being provided with a projection which receives terminal pins, and this projection is received in a longitudinal extending gap in a yoke ring when the bobbin is inserted therein. To form an aligned firm seating of the coil bobbin in the yoke ring, the second end flange of the bobbin is provided with a radially extending web which forms a press fit with the gap of the yoke ring.

4 Claims, 3 Drawing Sheets

MAGNET COIL WITH MEANS FOR ASSURING ADJUSTMENT AND FIRM SEATING OF THE COIL BODY IN A YOKE RING

BACKGROUND OF THE INVENTION

The present invention is directed to a magnet coil having an essentially hollow cylindrical coil body or bobbin composed of plastic with annular end faces with a first end face having projections in which sections of terminal pins of the magnet coil that proceed radial to the coil body are anchored. The coil body or bobbin is received in a yoke ring having an end wall with an inner cylindrical wall and an outer cylindrical wall so that the yoke ring coaxially surrounds the outside wall of the coil body or bobbin inserted into the yoke ring over the entire length and coaxially surrounds an inside wall to approximately a middle portion thereof, the outer cylindrical wall exhibits a gap over its entire length whose width at least corresponds to the width of the coil body projection and has means to assure adjustment and alignment in a firm seating of the coil body within the yoke ring.

Magnet coils having a coil bobbin which is received in a yoke ring and having means to assure adjustment and alignment and the firm seating of the coil body in the ring are already on the market. They are particularly suited for employment in the automotive field, particularly as valve coils for ABS systems.

The adjustment or alignment in the firm seating of the yoke ring is required in order to guarantee an unimpeded transport of the two assembled parts to a further processing station in which, in particular, the integration of a plurality of magnet coils into a housing of a valve control device can occur. Up to now, this was assured in that the projection is fitted into a gap of the yoke ring without play. This all around adjustment without play however becomes problematic when, for manufacturing reasons, a complete, sealing extrusion coating of the magnet coil with a soft casting compound is required since the coil body and/or the projections and yoke ring then directly abut one another at the end face at the terminal pin side without outwardly sealing casting compound. A lack of tightness can therefore occur in this abutting location.

SUMMARY OF THE INVENTION

An object of the present invention is to create a magnet coil having a coil bobbin received in a yoke ring that first enables a complete extrusion coating and second guarantees adjustment and firm seating of the coil body or bobbin in the yoke ring before and during the extrusion coating.

This object is attained in an improvement in a magnet coil having an essentially hollow cylindrical coil bobbin composed of plastic with annular end faces with the first end face being provided with a projection in which a particular portion of each terminal pin of the magnet coil proceeds radially into the coil body and is anchored integrally in the projection, a metal yoke ring for receiving the coil bobbin, the yoke ring having an outer cylindrical wall and an inner cylindrical wall extending from an end wall so that the yoke ring coaxially surrounds the outside walls of the inserted coil bobbin over the entire length thereof and coaxially surrounds an inside wall of the bobbin to about a middle thereof. The outer cylindrical wall has a gap over its entire length whose width at least corresponds to the width of the coil body projection and means to assure alignment and firm seating of the coil body when introduced into the yoke ring.

The improvements are that the projection has play in the gap in the yoke ring and that a web or projection is integrally formed on the second end face of the coil body and the web has a width that forms a press fit of the web in the gap upon introduction of the coil bobbin into the yoke ring.

Additional improvements include providing at least three radially directed noses or protrusions on the second end face so that the central position of the inserted bobbin in the yoke ring occurs with a uniform spacing of the wound coil bobbin from the walls of the yoke ring. In addition, the magnet coil is completely extrusion coated with a water-tight insulator.

Other advantages and features of the invention will be readily apparent from the following description of the preferred embodiments, the drawings and claims.

DESCRIPTION OF THE PREFERRED EMBODIMENTS

Figure 2:
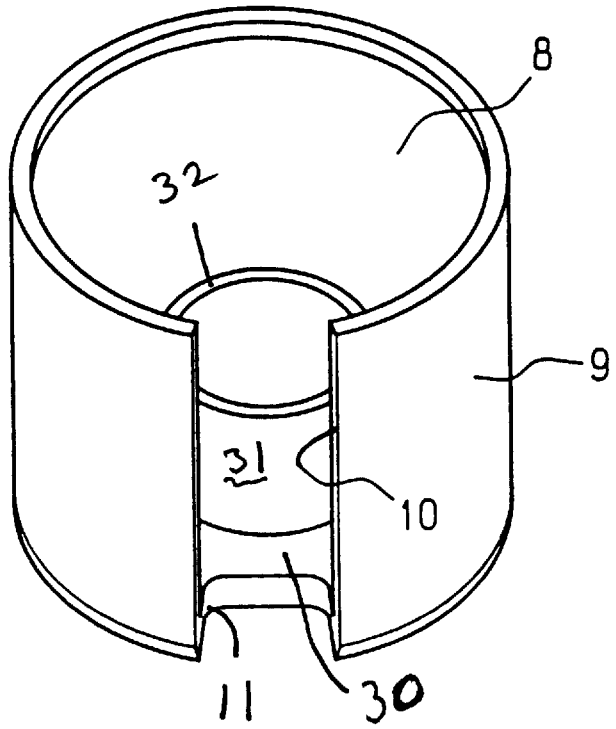
FIG. 2 is a perspective view of the yoke ring.
Figure 3:
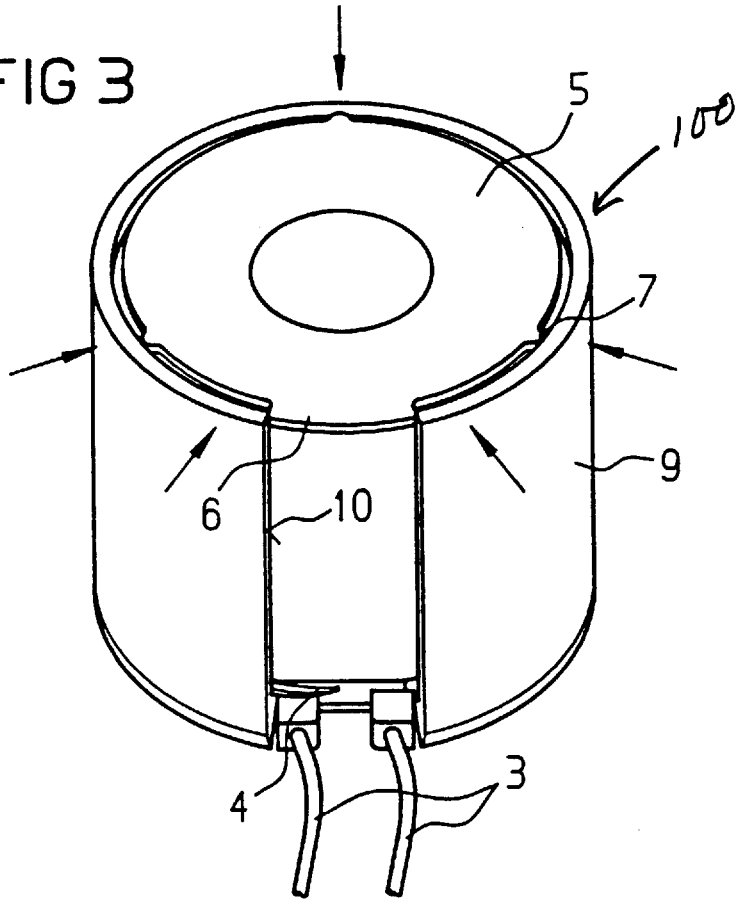
FIG. 3 is a perspective view of the coil bobbin of FIG. 1 being mounted with a coil winding being positioned in the yoke ring.
Figure 5:
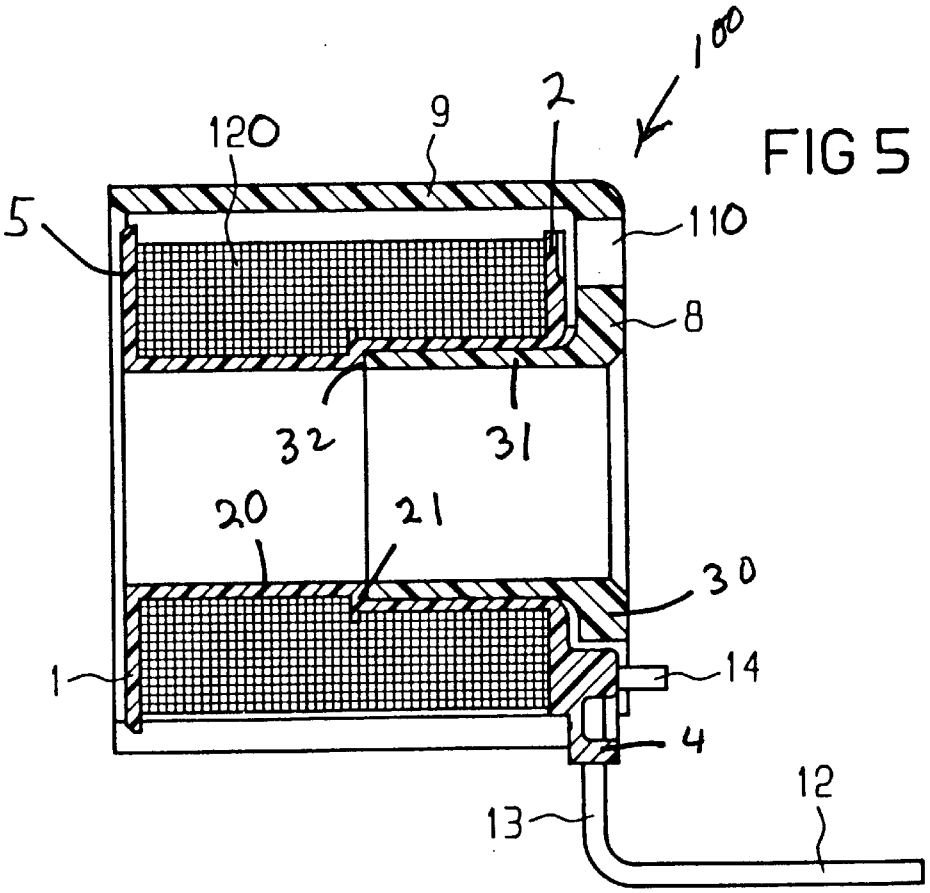
FIG. 5 is a cross-sectional view taken on lines V—V of FIG. 4.
Figure 4:
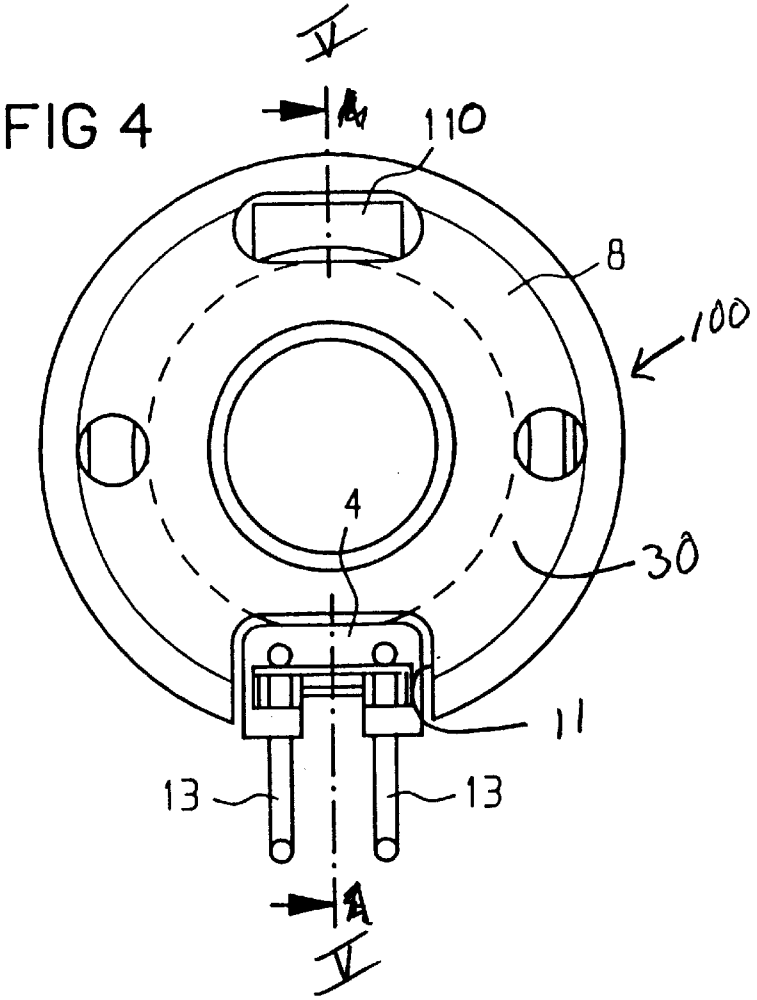
FIG. 4 is a end view of the magnet coil.

The principles of the present invention are particularly useful when incorporated into a magnet coil, generally indicated at 100 in FIGS. 3, 4 and 5. The magnet coil 100 is composed of a coil body, spool or bobbin 1 (shown in FIG. 1 free of a coil winding) and a metal yoke ring 8 shown in FIG. 2.

Figure 1:
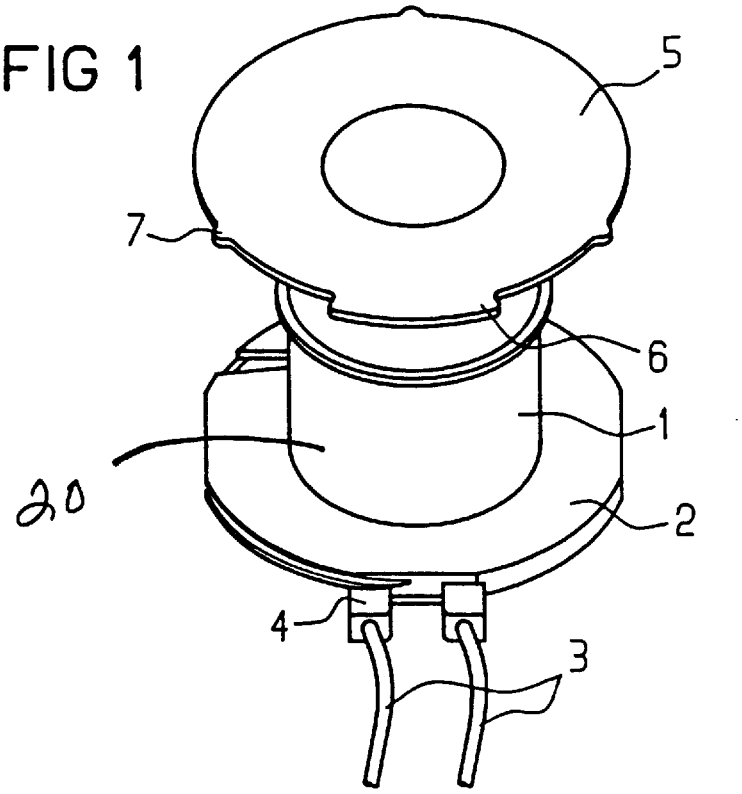
FIG. 1 is a perspective view of a coil body or bobbin free of the coil winding.

As illustrated in FIG. 1, the coil body or bobbin 1 has a cylindrical portion 20 which, as best illustrated in FIG. 5, has a transition or step 21. The cylindrical portion 20 is terminated at one end by a first end face or flange 2 and at the other end by a second end face or flange 5. As illustrated, the first end face 2 is provided with a projection 4 which serves for anchoring terminal pins 3. The second end face or flange 5 is provided with a radially extending web 6 and is also provided with three narrow noses or projections 7 that extend from the periphery of the flange 5.

The yoke ring 8, as best illustrated in FIGS. 2 and 5, has an end wall 30 from which an outer cylindrical wall 9 and a concentric inner wall 31 extend. The outer cylindrical wall 9 has a gap 10 (FIG. 2) which terminates in an opening 11 in the end wall 30. The gap 10 and the opening or recess 11 have the same width and the recess receives the projection 4 that has the terminals 3 when the bobbin 1 is inserted in the yoke ring 8.

As illustrated in FIGS. 3, 4 and 5, the magnet coil is assembled with the projection 4 received in the recess or opening 11 in the base 30. The projection is fitted in this gap 10 and the recess 11 with play while the web or projection 6 (FIG. 3) fits in the gap 10 with a press fit. As an additional adjustment or alignment, the three noses 7 guarantee a central seating of the coil body or bobbin 1 in the yoke ring 8 and a uniform bearing space of the wound coil body from the yoke ring 8 for the purpose of providing a faultless extrusion coating with a soft casting compound, for example, a material sold under a trade name Santoprene. The play or gap of approximately 0.5 mm between the projection 4 and the yoke ring 8 will result in that the magnet coil can also be tightly or densely extrusion coated at the end face on the side of the terminal pins 3. Moreover, the gap filled with the extrusion-coating material increases the insulation spacing between the terminal pins 3 and the yoke ring 8 so that the risk of shorts is reduced.

As illustrated in FIGS. 4 and 5, the end wall 30 of the yoke ring 8 has an opening 110 for the extrusion-coating material and the coil bobbin 1 has a coil or winding 120. In addition, each of the terminal pins 3 has been bent to have a radial portion 13 which extends radially from the projection 4 into a terminal region 12 which extends axially from the magnet coil 100. The radial sections 13 are embedded in the material of the coil body 1 or, respectively, the projection 4 and are thus anchored. To facilitate the wrapping and fastening of the wire ends of the coil 120, a second right angle portion 14 has been bent from the radial portion 13 to provide wrap-on pins.

As illustrated in FIG. 5, the cylindrical inner wall 31 only extends approximately half-way along the tubular portion 20 of the bobbin 1. The amount of insertion of the bobbin 1 into the yoke 8 is limited by the above-mentioned step 21 engaging an end 32 of the inner wall 31.

Although various minor modifications might be suggested by those skilled in the art, it should be understood that I wish to embody within the scope of the patent warranted hereon all such modifications as reasonably and properly come with the scope of my contribution to the art.

I claim:

1. In a magnet coil having an essentially hollow cylindrical coil bobbin composed of plastic material and having annular first and second flanges with the first flange having a projection in which a section of each terminal pin of a magnet coil extends radially to the coil bobbin and is anchored therein, a yoke ring of metal having an annular outer wall extending the length of the bobbin and an inner cylindrical wall extending a portion of the length of the bobbin, said yoke ring having a longitudinally extending gap over the entire length of the outer cylindrical wall with a width at least corresponding to the width of the projection in the coil bobbin, and means for assuring an alignment and firm seating of the coil bobbin within the yoke ring, the improvements comprising the projection of the bobbin having a play in the gap of the yoke ring, and the second flange of the bobbin having a radial extending web with a width to form a press fit with the gap when the coil bobbin is introduced into the yoke ring.

2. In a magnet coil according to claim 1, wherein the magnet coil is completely extrusion-coated with a watertight insulator.

3. In a magnet coil according to claim 1, wherein the second flange of the coil bobbin has at least three radially directed noses, so that when the central portion of the coil bobbin is inserted in the yoke ring, a uniform spacing of the wound coil bobbin from the yoke ring is obtained due to the noses engaging an internal surface of the outer cylindrical wall of the yoke ring.

4. In a magnet coil according to claim 3, wherein the magnet coil is completely extrusion-coated with a watertight insulator.

* * * * *